US005665002A

United States Patent [19]

Balwanz

[11] Patent Number: 5,665,002

[45] Date of Patent: Sep. 9, 1997

[54] CHAIR ASSEMBLY FOR AN AMUSEMENT RIDE

[76] Inventor: C. Grant Balwanz, 229 Golden Rod Dr., Seymour, Tenn. 37865

[21] Appl. No.: 610,161

[22] Filed: Feb. 29, 1996

[51] Int. Cl.[6] ..... A63G 9/00

[52] U.S. Cl. ..... 472/118; 427/119; 427/133

[58] Field of Search ..... 472/49, 50, 136, 472/131, 137, 133, 118, 125, 59, 60, 119; 297/484; 434/35, 29, 30, 55

[56] References Cited

U.S. PATENT DOCUMENTS

| | | | |
|---|---|---|---|
| 4,488,691 | 12/1984 | Lorch | 297/484 X |
| 4,540,218 | 9/1985 | Thomas | 297/484 X |
| 4,824,099 | 4/1989 | Rusu et al. | 434/55 X |
| 4,854,608 | 8/1989 | Barral | 297/484 X |
| 5,094,448 | 3/1992 | Hackett . | |
| 5,267,906 | 12/1993 | Kitchen et al. . | |
| 5,421,783 | 6/1995 | Kockelman et al. . | |
| 5,527,223 | 6/1996 | Kitchen et al. | 472/118 |

*Primary Examiner*—Kien T. Nguyen
*Attorney, Agent, or Firm*—Michael E. McKee

[57] ABSTRACT

A chair assembly for an amusement ride including a cage and at least one seat mounted within the cage utilizes a five-point harness assembly for securing an occupant within the seat of the chair assembly. The five-point harness assembly includes a release buckle, two strap sections which drape across the shoulders of a seat occupant, two strap sections for extending around the hips of the seat occupant from opposite sides thereof, and a strap section which extends between the legs of the seat occupant. The ends of the strap sections are adapted to cooperatively interlock with the release buckle in a manner which prevents the release of the strap sections therefrom without the aid of a special tool. In addition, the chair assembly includes bearing assemblies mounted on each side of the cage which accommodate the rotation of the cage relative to the remainder of the amusement ride.

17 Claims, 5 Drawing Sheets

CHAIR ASSEMBLY FOR AN AMUSEMENT RIDE

BACKGROUND OF THE INVENTION

This invention relates generally to the art of amusement rides and relates, more particularly, to a chair assembly for such a ride.

Typically, amusement rides do not require that any tasks be performed by an occupant while an amusement ride is in operation. In other words, during the course of an amusement ride, an individual is normally expected to simply remain seated in a seat and permit the ride to move his body in a manner, e.g. with jerks or other sudden motions, which imparts a thrill to the individual.

It is desirable, or course, that an individual remain relatively safely within his seat during the course of an amusement ride, and the advent of amusement rides which employ bungee cords for bodily moving an individual through the air have increased safety considerations associated with such rides.

It is an object of the present invention to provide a new and improved chair assembly for an amusement ride.

Another object of the present invention is to provide such a chair assembly for an amusement ride wherein an occupant of the chair assembly is moved through the air with the aid of a bungee cord.

Yet another object of the present invention is to provide such a chair assembly which is well-suited for amusement rides wherein an occupant of the chair may be jerked, swung or turned upside down during the course of the ride.

Still another object of the present invention is to provide such a chair assembly whose structure enhances the safety of the occupant while seated therein.

A further object of the present invention is to provide such a chair assembly which is uncomplicated in construction yet effective in operation.

SUMMARY OF THE INVENTION

This invention resides in a chair assembly for an amusement ride including means providing a cage having an interior and two opposite sides and further includes a seat secured within the interior of the cage.

In one aspect of the invention, a five-point harness assembly is associated with the seat for securing an occupant therein and includes a release buckle, two strap sections for draping across the shoulders of the seat occupant, two strap sections for extending around the hips of the seat occupant from opposite sides thereof, and a strap section for extending between the legs of the seat occupant. Each of the strap sections has an end which is releasably securable to the release buckle at a location disposed in front of the occupant's torso. When secured about the occupant of the seat, the harness assembly secures the occupant within the seat and helps to secure the seat within the cage.

In another aspect of the invention, the chair assembly includes means associated with the opposite sides of the cage for pivotally connecting the cage to the remainder of the amusement ride so that during the course of a ride performed with the amusement ride, the cage is permitted to pivot relative to the remainder of the ride in a manner which prevents the exposure of the remainder of the ride to undue strain. If the chair assembly is connected to the remainder of the amusement ride by way of bungee cords, the pivoting means prevents the development of kinks in the cords during the operation of the amusement ride.

DETAILED DESCRIPTION OF THE ILLUSTRATED EMBODIMENT

Figure 1:
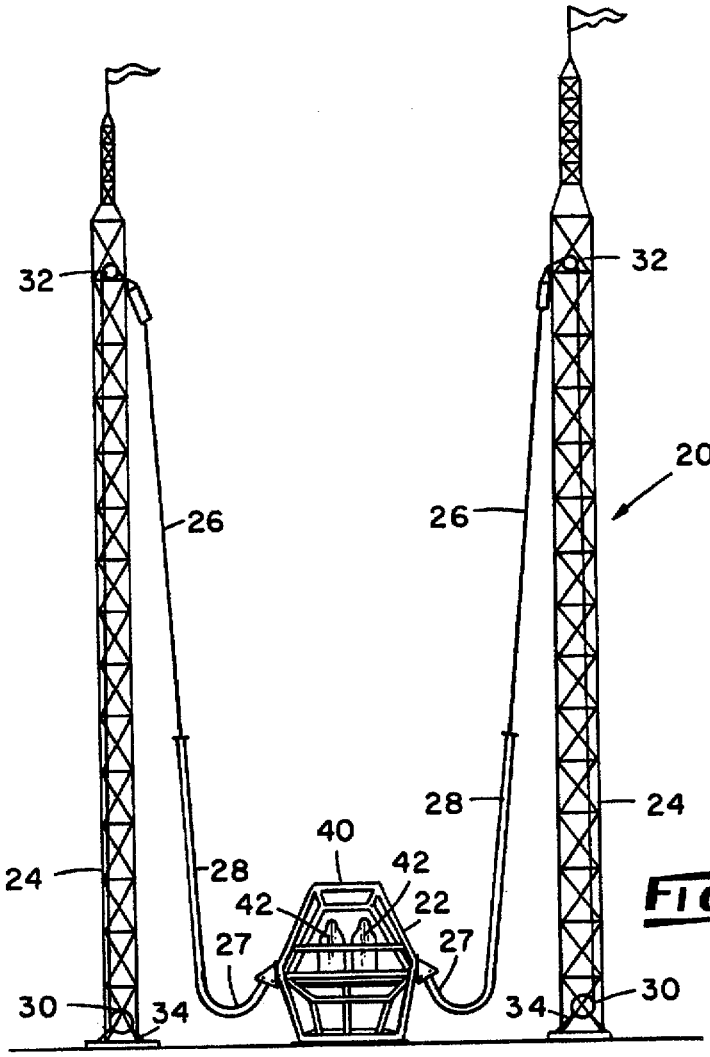
FIG. 1 is a perspective view of an amusement ride within which an embodiment of a chair assembly is utilized.

Turning now to the drawings in greater detail, there is illustrated in FIG. 1 an amusement ride 20 within which an embodiment of a chair assembly 22 is employed. The depicted ride 20 includes a pair of stationary towers 24 between which the chair assembly 22 is positioned. Joined to each side of the chair assembly 22, in a manner described in greater detail herein, is one end, indicated 27, of a bungee cord 28, and the other, opposite end of the bungee cord 28 is joined to a tensioning cable 26. The tensioning cable 26 is, in turn, connected to a rotatable spool 30 by way of a pulley 32 secured adjacent the upper end of a corresponding tower 24. A electric motor 34 is drivingly connected to the spool 30 so that upon actuation of the motor 34, the cable 26 is wound about the spool 30 to tension the bungee cords 28 disposed on each side of the chair assembly 22 to a selected condition.

By securing the chair assembly 22 to the ground and then winding the cables 26 for a predetermined distance about the spools 30, the bungee cords 28 are stretched from a relaxed, undeformed condition to a stretched (i.e. lengthened) condition. By subsequently releasing the chair assembly 22 from the ground while the bungee cords 28 are in the stretched condition, the assembly 22 is thrown upwardly from the ground by the bungee cords 28 as the cords 28 attempt to return to the relaxed condition. It will be understood that during the period that the chair assembly 22 is airborne, the chair assembly 22 may turn upside down and experience a number of bounces before the chair assembly 22 returns to a position of rest. As will be apparent herein, the structure of the chair assembly 22 securely maintains an occupant seated therein throughout the course of the ride during which the assembly 22 may be turned upside down or experiences hard bounces.

Figure 2:
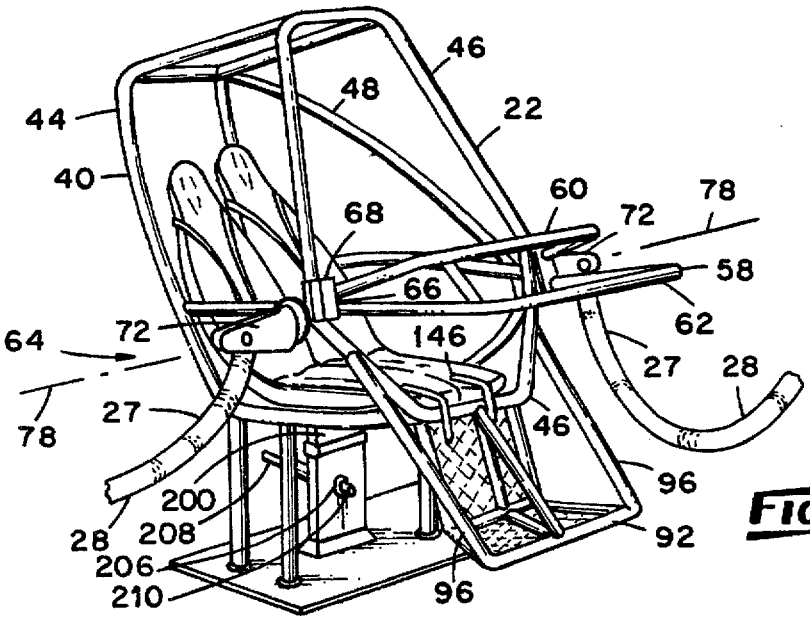
FIG 2 is a perspective view of the chair assembly of the FIG 1 ride.
Figure 3:
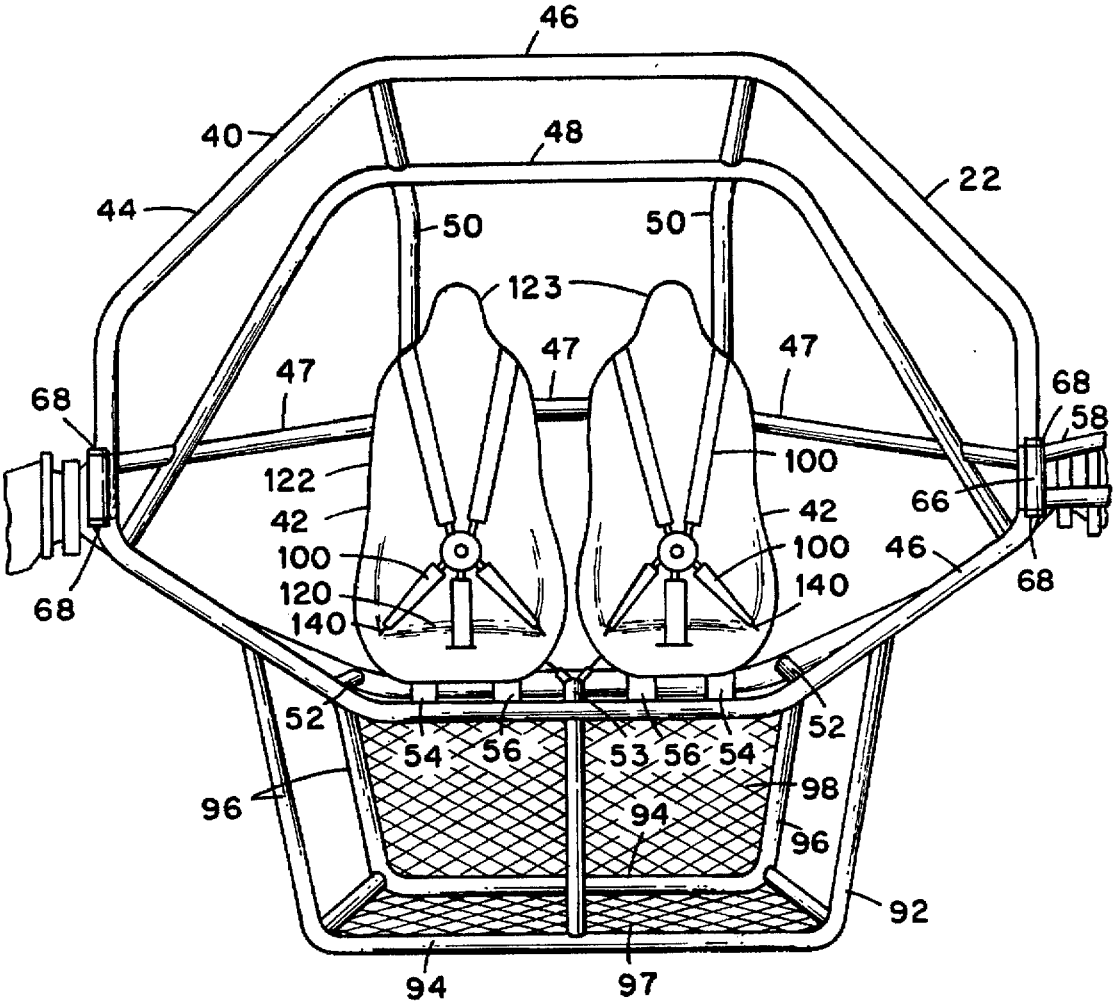
FIG. 3 is a front elevational view of the chair assembly of the FIG. 1 ride.

With reference to FIGS. 2 and 3, the chair assembly 22 includes a cage 40 having an interior and a pair of seats 42 fixedly secured within the interior of the cage 40. The cage 40 includes an arrangement of steel tubular members which are joined together with welds to form a protective frame about the seats 42. As best seen in FIG. 3, the cage 40 includes an upper section 44 including tubular members 46, 48 which generally encircle the upper section 44 and a tubular member 47 which extends transversely across the back of the section 44. The tubular members 46, 48 and 47 are joined by other, albeit shorter tubular members extending therebetween. For example, a pair of tubular members 50 have portions which extend substantially upwardly along the back of the section 44 and tubular members 52, 53 which extend across the bottom of the upper section 44. Together, the joined tubular members of the cage 40 resemble the frame of a box-like receptacle having an opening which is directed forwardly of the seats 42. The cage 40 also includes two pairs of horizontally-oriented bars 54, 56 which are secured to the remainder of the upper section 44 so as to extend from front to back therein. As will be apparent herein, the bars 54, 56 provide supports upon which the seats 42 are mounted.

The cage 40 also includes a closure 58 (FIGS. 2 and 3) which is positionable across the forwardly-directed opening of the upper section 44 for closing the front opening thereof and for providing a protective barrier across the front of the section 44. In the depicted embodiment 22, the closure 58 includes a pair of somewhat U-shaped (as seen from above) steel tubular members 60, 62 which extend between the opposite sides of the upper section 44 and are joined together, as with welds, at the ends thereof by way of a substantially vertically-oriented, open-ended sleeve-like section 66. For purposes of joining the closure 58 to the upper section 44, a pair of lugs 68 are attached to the tubular member 46 of the upper section 44 adjacent each side thereof, and the lugs 68 include vertically-aligned openings therein. As exemplified by the sleeve-like section 66 depicted in FIG. 5, each sleeve-like section 66 of the closure 66 is positionable between a corresponding pair of lugs 68, and a pin 70 is directed downwardly through the aligned openings in the lugs 68 and the interior of the sleeve-like section 66 to thereby pin the ends of the closure 58 across the upper section 44. Each pin 70 is, in turn, releasably secured through the lugs 68 and sleeve-like section 66 with a suitable key 71.

If one of the pins 70 is removed from the sleeve-like section 66 disposed at one end of the closure 58, then the closure 58 can be pivoted relative to the upper section 44 about the other pin 70 disposed at the opposite end of the closure 58 from one position (illustrated in FIG. 2) at which the closure 58 spans and thereby closes the forwardly-directed opening of the upper section 44 to another position (illustrated in FIG. 3) at which the forwardly-directed opening in the upper section 44 is opened. It follows that by pivoting the closure 58 to the FIG. 3 opened condition, the seats 42 are accessible to individuals desiring to ride the ride 20, and by returning the closure 58 to the FIG. 2 closed condition (and re-securing the closure end in place with the pin 70), the forwardly-directed opening of the upper section 44 is closed. It follows from the foregoing that the structure of the upper section 44 and closure 58 resemble that of a frame-like clam shell arrangement whose sections are movable relative to one another between opened and closed conditions.

With reference again to FIGS. 2 and 3, the cage 40 also includes a foot rest 92 attached to so as to depend downwardly from the upper section 40. In the depicted embodiment 22, the foot rest 92 includes a tubular frame arrangement including a lower, horizontally-disposed portion 94 and upstanding post portions 96 extending between the lower portion 94 and the tubular members (e.g. the tubular member 46) of the upper section 44. Steel platens 97 are secured across the lower portion 94 to provide a platform for the occupant's feet, and another platen 98 is secured across the rearwardmost post portions 96, as best shown in FIG. 2, to provide a back for the foot rest 92.

Figure 4:
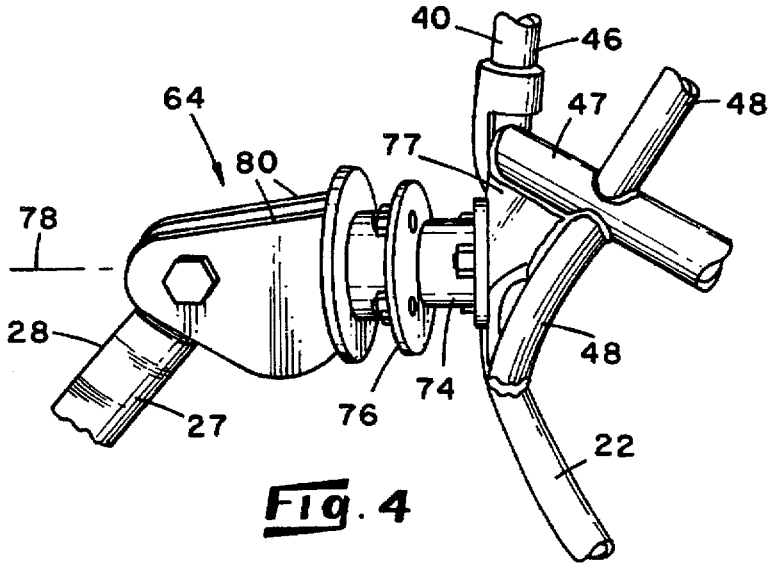
FIG. 4 is a perspective view of one fragment of the FIG. 2 chair assembly as seen generally from the back of the assembly.
Figure 5:
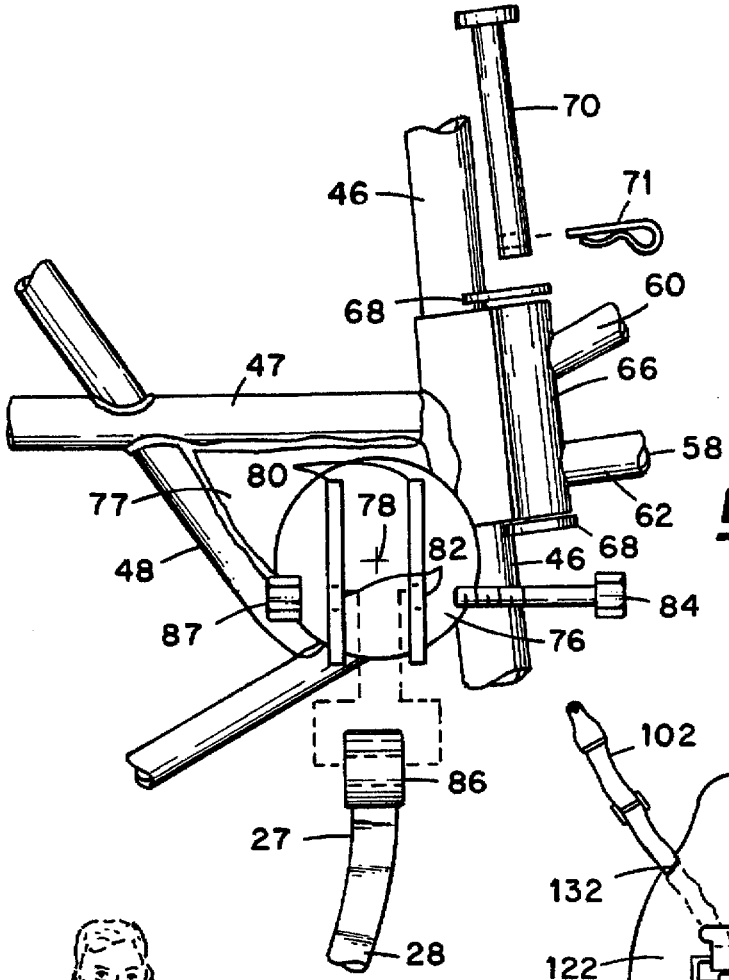
FIG. 5 is a side elevational view of the FIG. 4 fragment as seen generally from the left in FIG. 4.

With reference to FIGS. 2, 4 and 5, it is a feature of the chair assembly 22 that it includes means, generally indicated 64, enabling the cage 40 to pivot relative to the remainder of the amusement ride 20 to which the cage 40 is secured. In the depicted embodiment 22, such means 70 includes a pair of bearing assemblies 72 mounted on opposite sides of the cage 40 for pivotally joining the cage 40 to the end 27 of a corresponding bungee cord 28. As best shown in FIG. 4, each bearing assembly 72 includes a spindle-carrying inner portion 74 secured in a stationary condition with respect to the cage 40 and a hub-carrying outer portion 76 to which the bungee cord end is secured. The inner portion 74 is rigidly secured, as with welds, to a plate member 77 which is, in turn, welded in place across a pair of adjacent tubular members, e.g. members 46, 47, 48, of the cage 40 so that the inner portion 74 extends to one side of the cage 40. Each outer portion 76 is rotatably fixed to the inner portion 74 to accommodate rotation of the outer portion 76 relative thereto about a rotation axis 78. The bearing assemblies 72 are arranged relative to one another so that the rotation axes 78 are coincident with one another and, when the cage 40 is disposed in a position of rest upon the ground as depicted in FIG. 2, the rotation axes 78 are arranged horizontally. Examples of bearing assemblies which have been found to be suitable for use as a bearing assembly 72 include bearing assemblies currently utilized in conjunction with the wheels of a straight-axle vehicle, such as the rear wheels of a front-wheel drive vehicle.

Fixedly secured to the outer portion 76 are a pair of somewhat triangularly-shaped plates 80 which are arranged in spaced relationship with one another and define a pair of aligned openings 82 (best shown in FIG. 5) for receiving a bolt 84. For purposes of connecting the bungee cord 28 to the cage 40, the bungee cord end 27 forms a loop 86 therein for accepting the bolt 84. To fasten the cord 28 to the plates 80, the cord 28 is positioned between the plates 80 so that the loop 86 is aligned with the openings 82, and then the bolt 84 is directed through the aligned openings 82 and suitably secured to the plate 80, as with a nut 87 threaded upon the end of the bolt 84 opposite the bolt head.

It follows from the foregoing that the bungee cord 28 is secured to the cage 40 by way of the bearing assemblies 72, and that therefore the cage 40 is permitted to pivot and, more particularly, rotate about the rotation axes 78 relative to the bungee cord ends 27. Therefore, during operation of the ride 20 during which the cage 40 may be expected to roll or be turned upside down, the bearing assemblies 72 prevent the bungee cords 28 from exposure to undue strain which could otherwise result from the development of kinks, and the bearing assemblies 72 are advantageous in this respect.

With reference to FIGS. 3 and 6–9, each seat 42 includes a bottom section 120 and a back section 122 (having a head rest 123) formed with a base 124 (FIG. 7) which has been overlain with a layer of padding 92 secured over the portions of the base 124 against which the occupant engages the seat 42 when seated therein. The base 124 is constructed of hard plastic which has been molded to generally conform to the contour of an occupant when seated therein. Each seat 42 is fastened to a corresponding pair of horizontally-disposed bars 54, 56 (FIG. 3) of the upper section 44 of the cage 40 with bolts 99 (best shown in FIG. 8) which extend through the bars 54, 56 and the bottom portion of the seat base 86. An amount of elastomeric padding 128 (FIG. 9) is fixedly secured about the tubular member 47 to cushion the space provided between the tubular member 47 and the back section 122 of the seat 42.

Figure 6:
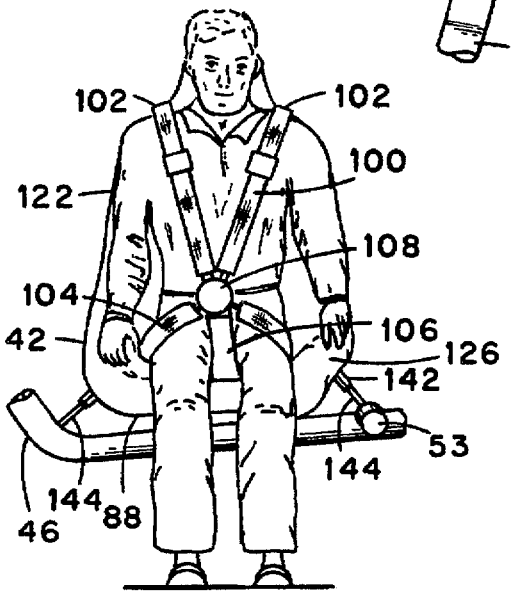
FIG. 6 is a front elevational view of another fragment of the FIG. 1 chair assembly, shown with an occupant seated within one of its seats.
Figure 7:
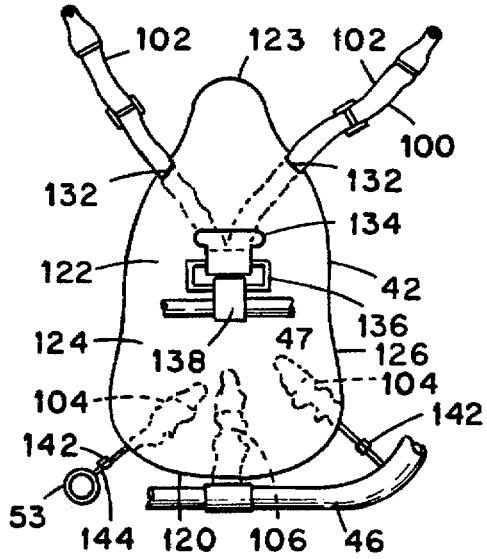
FIG. 7 is a rear elevational view of the FIG. 6 fragment.
Figure 8:
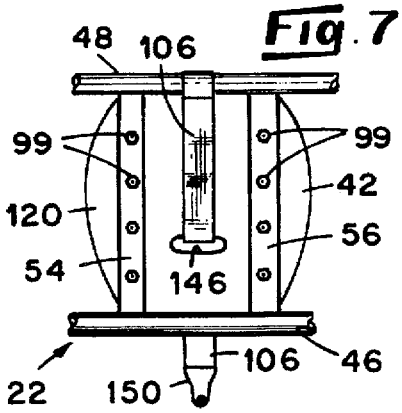
FIG. 8 is a bottom plan view of the FIG. 6 fragment.

It is also a feature of the chair assembly 22 that it includes a five-point harness assembly 100 associated with each seat 42 for securing an occupant within the seat 42. As best shown in FIGS. 6 and 7, each harness 100 includes five elongated strap sections, described herein, which are each anchored at one end to the cage 40 and is attachable at its other end to a single release buckle 108 disposed in front of the occupant. Two of the strap sections, indicated 102, are draped across the shoulders of the occupant, two strap sections, indicated 104, are draped across the hips of the occupant from opposite sides thereof, and the remaining one strap section, indicated 106 extends upwardly between the legs of the occupant. Each of the straps 102, 104 of 106 converge about the occupant's torso as shown in FIG. 6 to a single location disposed in front of the occupant at which the release buckle 108 is positioned. As will be apparent herein, the release buckle 108 accepts the ends of the strap sections 102, 104 and 106 and holds the end of the strap sections 102, 104 and 106 together during the course of a ride.

Figure 9:
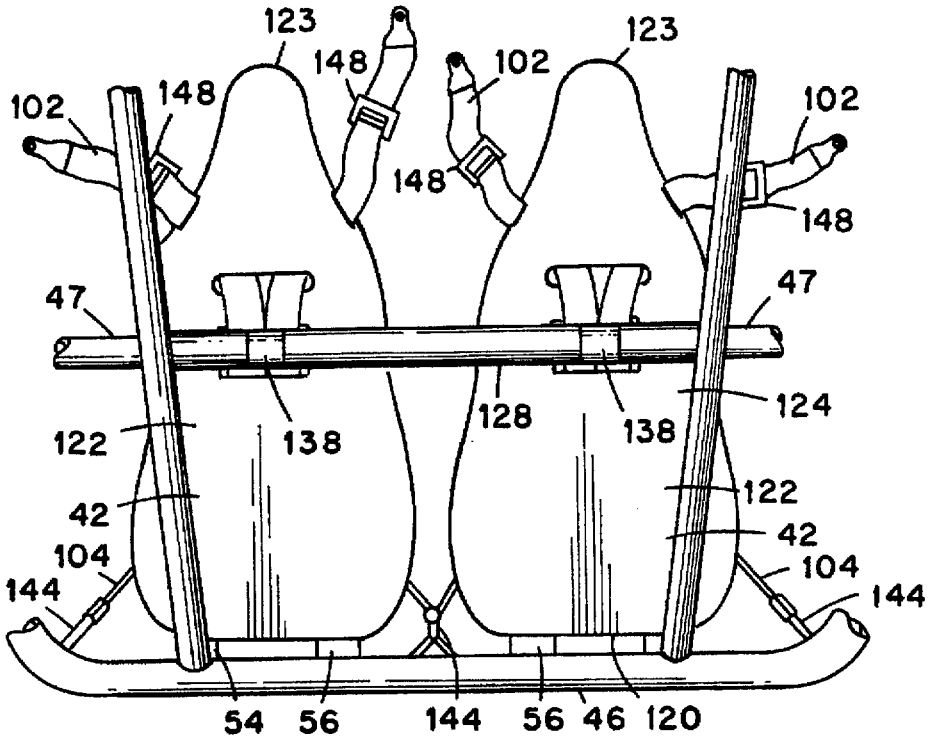
FIG. 9 is a rear elevational view of the FIG. 2 chair assembly as seen generally from the back in FIG. 2.

With reference to FIGS. 7 and 9, each of the shoulder straps 102 is routed between the seat base 86 and the padding 92 by way of an opening 132 provided therebetween adjacent the head rest 91 and are directed out of the seat 42 through a slot-like opening 134 provided in the back portion of the seat base 124 where it is wrapped about so as to be suitably secured to a common ring-like buckle 136 disposed behind the back portion of the seat 42. This buckle 136 is, in turn connected to the tubular member 47 of the cage 40 with a strap 138 to thereby anchor the shoulder straps 102 to the cage 40.

Figure 10:
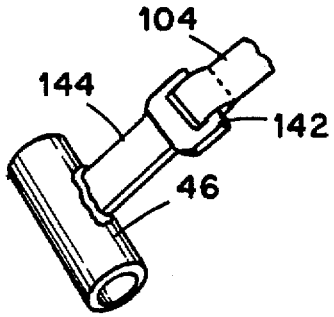
FIG. 10 is a perspective view of still another fragment of the FIG. 2 chair assembly.

Each of the strap sections 104 extends across the hips of the occupant from the release buckle 108, through an opening 140 (FIG. 3) provided in a corresponding side of the seat 42 and are secured to the cage 40. To this end and with reference to FIG. 10, the end of the strap sections 104 opposite the release buckle 108 is secured to, e.g. sewn about, a clip 142, and the clip 142 is secured (i.e. welded) to a clip-retaining strut 144 which is fixedly secured to either a tubular member 46 of the cage 40 disposed to one side of the seat 40 or to the tubular member 53 of the cage 40 (best shown in FIGS. 6 and 7) disposed generally between the sections 42. Thus, the (hip) strap sections 106 are anchored to the cage 40 through the seat 42 so that when secured across the hips of the occupant and connected to the release buckle 108, the strap sections 104 hold the occupant against the seat 42 and help to secure the seat 42 to the cage 40.

The strap section 106 extends generally downwardly (as viewed in FIG. 6) from the release buckle 108, through a slot-like opening 146 formed substantially centrally of the bottom section 120 of the seat 42 and is attached (i.e. sewn) about the tubular member 46 of the cage 40 to anchor the seat 42 thereto at a location disposed generally behind the back of the seat 42. Thus, each of the shoulder strap sections 102 and the strap section 106 are connected to the tubular members of the cage 40 at locations disposed generally behind the seat 42 so that when coupled together in front of the occupant by way of the release buckle 108, the straps 102, 106 substantially encircle the torso of the seat occupant, as well as a major portion of the bottom section 120 and the back section 122 of the seat 42, to secure the occupant within the seat 42 and, as is the case with the (hip) sections 104, help to secure the seat 42 to the cage 40.

Figure 11:
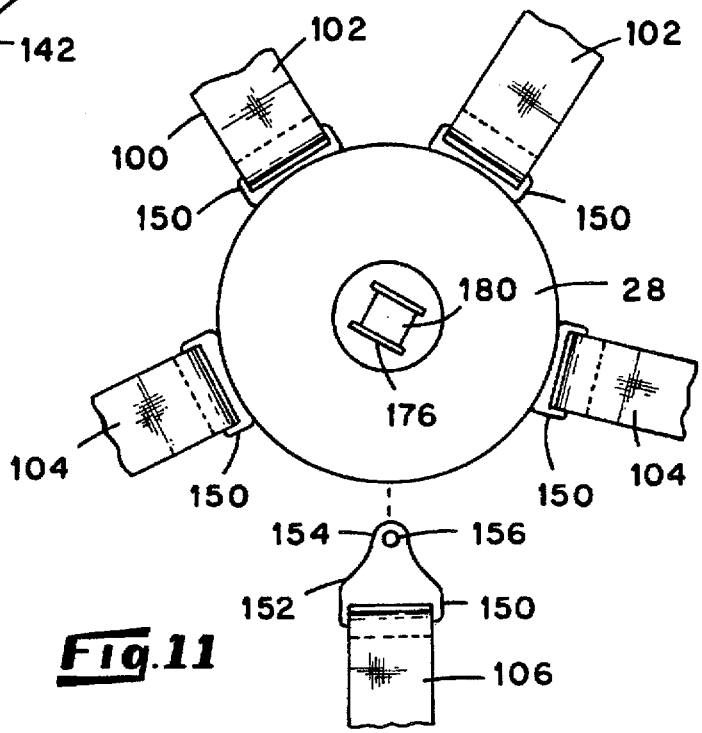
FIG. 11 is a front elevational view of a fragment of one of the harness assemblies of the FIG. 2 chair assembly.

Each of the strap sections 102, 104 and 106 is comprised of a fabric portion which extends along a major portion of the length of the sections and, if desired, may include adjustment means, such as an adjustment buckle 148 (FIG. 9), along its length to accommodate an adjustment in length of the corresponding strap section to provide a better fit about the occupant seated within the seat 42. In addition and as best shown in FIG. 11, each strap section terminates at a metal clip 150 about which the fabric portion of each strap section is sewn. Each clip 150 is provided with a generally platen-like body 152 having a somewhat pointed, or narrow, end portion 154 having a hole 156 formed therein. As will be apparent herein, the narrow end portion 154 cooperatively interlocks with the release buckle 108 by way of the hole 156.

Figure 12:
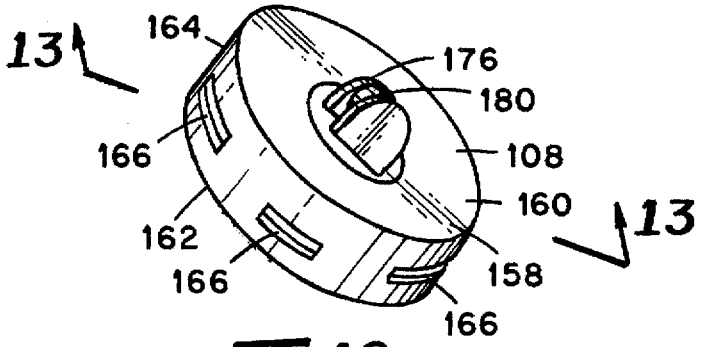
FIG. 12 is a perspective view of the release buckle of the FIG. 11 harness assembly.
Figure 13:
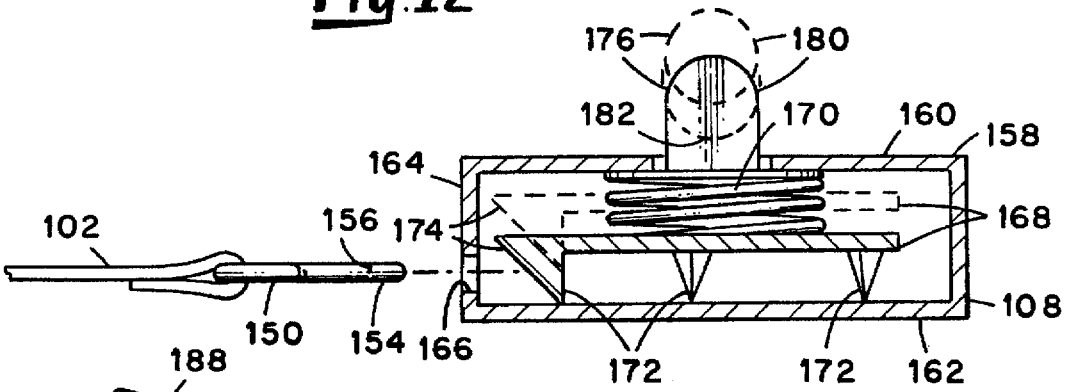
FIG. 13 is a cross-sectional view of the FIG. 12 release buckle taken about along line 13—13 of FIG. 12 and a fragment of a strap section of the FIG. 11 harness assembly.

With reference to FIGS. 12 and 13, the release buckle 108 includes a substantially cylindrically-shaped housing 158 having two opposite face plates 160, 162 joined by a cylindrical sidewall 164, and a series of (i.e. five) slots 166 are arranged about the sidewall 164 of the housing 158 for accepting the end portions 154 of the clips 150 when inserted therein. The internal working components of the release buckle 108 are well known in the art so that a detailed description is not believed to be necessary. Briefly, however, the buckle 108 includes a latch mechanism 168 and a compression spring 170 mounted between the latch mechanism 168 and the face plate 160 of the housing 158 for spring-biasing the latch mechanism 168 toward the opposite face plate 162. The latch mechanism 168 includes a series of hook-like protuberances 172 adapted to be received by the openings 156 in the clips 150.

The clips 150 and protuberances 172 cooperate to permit an insertion of the clip end portion 154 into a slot 166 of the housing 158 so that the clip end portion 154 is releasably interlocked within the buckle 108. In this connection, as the clip end portion 154 is forcibly urged into a corresponding slot 166, the clip end portion 154 engages a side surface, indicated 174, of the protuberance 172 and urges the protuberance 172 (and thus the latch mechanism 168) away from the face plate 162 (in opposition to the biasing force of the spring 170) from the position illustrated in solid lines in FIG. 13 to the position illustrated in phantom in FIG. 13. Upon insertion of the clip end portion 154 into a slot 166 to a position at which the clip opening 156 is positioned in registry with the protuberance 172, the protuberance 172 is permitted to return to its original, FIG. 13 solid-line position at which the protuberance 172 is received by the clip opening 156 so that the clip 156 is captured within the buckle 108 until the protuberance 172 is retracted from the opening 156.

For purposes of withdrawing the protuberances 172 (and thus the latch mechanism 168) from the clip openings 156, the latch mechanism 168 includes a centrally-disposed boss 176 which protrudes through an opening 178 provided in a face plate 160 of the housing 158. The boss 176 includes a transversely-arranged pin 180 which is separated from the face plate 160 by a spacing 182 (FIG. 13). As will be apparent herein, this spacing 182 is adapted to receive the end of a tool 184 (FIGS. 14 and 15) with which the pin of the boss 176 can be urged away from the face plate 160 and against the biasing force of the spring 170 to its FIG. 13 phantom-line (release) position.

Figure 14:
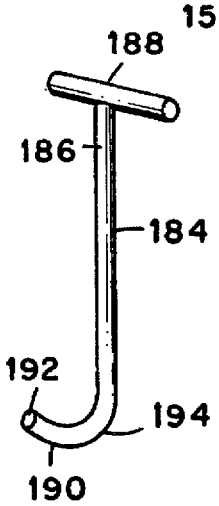
FIG. 14 is a perspective view of a tool used for releasing the strap sections from the release buckle.
Figure 15:
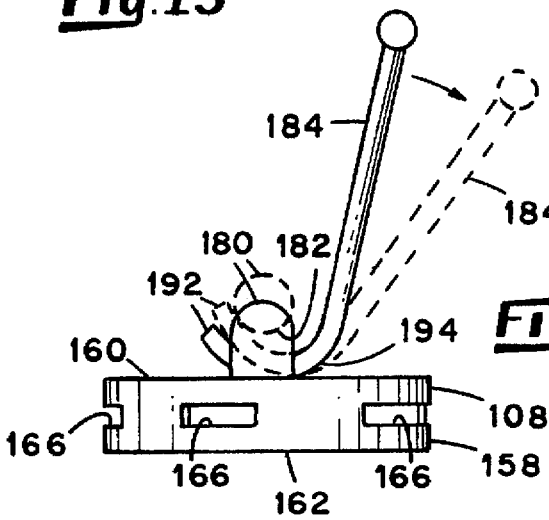
FIG. 15 is a side elevational view of the release buckle of FIG. 13 and the tool of FIG. 14 shown positioned in operative relationship to one another for releasing the strap sections from the buckle.

As best shown in FIG. 14, the tool 184 includes an elongated shank 186 having a T-shaped handle 188 formed at one end thereof and a crooked end portion 190 formed at the end of the shank 186 opposite the handle 188. The crooked end portion 190 has a tip 192 which is receivable by the spacing 182 provided between the boss pin 180 and the housing face plate 160, and the crooked end portion 190 includes a bend 194 which is spaced a short distance from the tip 192. By positioning the tip 192 within the spacing 182 and arranging the bend 194 against the surface of the face plate 160 as shown in FIG. 15, the tool 184 can be pivoted relative to the buckle housing 158 from, for example, the position illustrated in solid lines in FIG. 15 to the position illustrated in phantom in FIG. 15. It follows that as the tool 184 is used in this manner, the tool 184 acts as a lever while the bend 194 acts as a fulcrum for the lever. Upon lifting the boss 176 to the FIG. 15 phantom-line (release) position, the protuberances 172 of the latch mechanism 168 are withdrawn from the openings 156 provided in the clip end portions 154 so that the clips 150 are released from the latch mechanism 168 and can be withdrawn from the slots 166 of the buckle 108.

The boss 176 is shaped and is of a sufficiently small size to prevent the boss 176 from being easily grasped by an individual. In addition, the spring 170 of the buckle 108 is of sufficient strength so that if the boss 176 is grasped by an individual, the boss 176 is difficult to lift relative to the housing 158 to a release position. The tool 184 is intended to be in the custody of the operator of the amusement ride 20, rather than a seat occupant, for releasing the harness strap sections from the buckle 108 at the end of a ride. Thus, the release buckle 108, and more particularly the boss 176 and spring 170, render it difficult for an occupant to release himself from the harness assembly 100 at a time, such as during the operation of the ride 20, when it may not be safe to do so, and the buckle 108 is advantageous in this respect.

With the exception of the release buckle 108, the harness assembly 100 is of a type currently used in stock car racing vehicles (such as a NASCAR vehicle) for securing a driver within the seat of the vehicle. Such a harness assembly is available from SFI Foundation Inc. under the trade designation Simpson. As far as the release buckle 108 is concerned, the release buckle supplied with the Simpson harness has been modified to construct the buckle 108. In particular, the release buckle of the Simpson harness is supplied with a lever coupled to the pin 180 of the boss 176 enabling an individual, i.e. the race car driver, to quickly lift the boss 108 to its release position. To form the release buckle 108, the lever is removed from the remainder of the buckle leaving the boss pin 180 exposed. The tool 184, however, is not a conventional item and has been specially designed to cooperate with the release buckle 108 in the manner described above.

It follows from the foregoing that a chair assembly 22 has been described which, by way of its cage 40, provides a protective frame about the occupants of the seats 42 mounted therein and, by way of each five-point harness assembly 100, provides an effective means for securing the occupant within the seat 42 as well as an effective means for anchoring the seats 42 to the cage 40. In addition, a release buckle 108 and a cooperating tool 184 have been described which facilitate the release of the strap sections 102, 104, 106 from the buckle 108, and bearing assemblies 72 have been described which are mounted on opposite sides of the cage 40 for accommodating rolls and flips of the cage 40 while preventing kinks from being formed in the bungee cords 28 while as such rolls and flips are effected.

Figure 16:
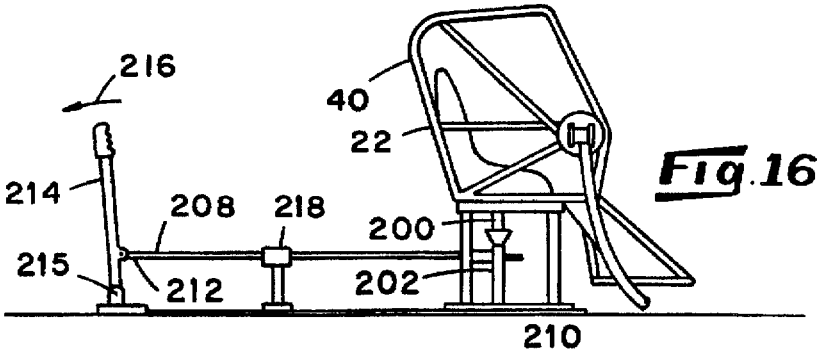
FIG. 16 is a side view of the FIG. 2 chair assembly and the means by which the assembly is secured to the ground.

For releasably securing the chair assembly 22 to the ground, there is attached to the cage 40 a platen-like post 200 adapted to be received by an upwardly-opening sleeve-like guideway 202. The post 200 is fixedly secured, as with welds, to the underside of the cage 40 and defines a fore-to-aft through-opening along its length. The guideway 202, in turn, is fixedly secured to the ground in a substantially vertical orientation and includes a pair of aligned holes 206 (one shown in FIG. 1) for accepting one end 210 of a rod 208. When the post 200 is received by the guideway 202 and the through-opening of the post 200 is aligned with the guideway holes 206, the rod end 210 can be inserted through the post 200 and guideway 202 to pin the chair assembly 22 to the ground. The opposite rod end 212 is pivotally connected to a lever 214 which, in turn, is pivotally connected to the ground by way of a pivot pin 215. In order to release the chair assembly 22 from the guideway 202, the lever 214 is manually moved in the direction of the FIG. 16 arrow 216 to withdraw the rod end 210 from the post opening. If desired, the rod 208 may be supported along its length by means of a member 218 within which the rod 208 is slidably positioned.

It will be understood that numerous modifications and substitutions can be had to the aforedescribed embodiment without departing from the spirit of the invention. For example, although the chair assembly 22 has been shown and described for use in connection with an amusement ride 10 utilizing towers 24 and bungee cords 28 for throwing the chair assembly 22 into the air, the chair assembly 22 can, by way of its bearing assemblies 72, be mounted on a Ferris wheel for use as a suspended chair compartment thereon. Accordingly, the aforedescribed chair assembly 22 is intended for the purpose of illustration and not as limitation.

I claim:

1. A chair assembly adapted to be used with an amusement ride comprising:

a cage having an interior;

a seat secured within the interior of the cage; and a five-point harness assembly associated with the seat for securing an occupant therein, the harness assembly including a release buckle, two strap sections for draping across the shoulders of the seat occupant, two strap sections for extending around the hips of the seat occupant from opposite sides thereof, and a strap section for extending between the legs of the seat occupant wherein each of said strap sections has an end which is releasably securable to the release buckle at a location disposed in front of the occupant's torso; and wherein the cage has two opposite sides and the assembly further includes means associated with the opposite sides of the cage for pivotally connecting the cage to the amusement ride for use therewith so that the cage is permitted to pivot relative to the amusement ride and wherein the pivoting means includes two bearing assemblies joined to the cage on opposite sides thereof, and each bearing assembly includes a spindle-carrying portion which is secured in a stationary condition with respect to the cage and a hub-carrying portion which is rotatably secured to the spindle-carrying portion for rotation with respect thereto, and the pivoting means is adapted to be connected to the amusement ride by way of the hub-carrying portion so that when the pivoting means is connected to the amusement ride as aforesaid, the cage is permitted to rotate relative to the amusement ride as the spindle-carrying portion is permitted to pivot relative to the hub carrying portion.

2. The chair assembly as defined in claim 1 wherein at least one of the strap sections is anchored directly to the cage.

3. The chair assembly as defined in claim 1 wherein the cage includes tubular members joined together in a frame-like arrangement and each of the strap sections is anchored directly to the tubular members of the cage.

4. The chair assembly as defined in claim 1 wherein the seat includes a body defining a series of through-openings therein and each of the strap sections extend through a corresponding opening defined within the body of the seat.

5. The chair assembly as defined in claim 1 wherein each of the strap sections terminates in a clip and the release buckle includes a housing and means associated with the housing for cooperatively interlocking with the clip of each strap section to secure each clip to the release buckle, the interlocking means includes a latch mechanism which is movable between one position at which the interlocking means is cooperatively interlocked with the clips of the strap sections and a release position at which the clips are released from the release buckle, and the release buckle further includes means for biasing the latch member relative to the housing from the release position toward said one position.

6. The chair assembly as defined in claim 5 wherein the housing includes a face plate having an opening therein, the latch mechanism includes a major portion which is positioned within the housing and a boss portion which protrudes through the opening of the face plate of the housing so that the latch mechanism can be moved from said one position to the release position by moving the boss portion relative to and away from the face plate.

7. The chair assembly as defined in claim 6 in combination with a tool for forcibly moving the boss portion away from the face plate as the tool is positioned against the face plate and is manipulated as a lever for moving the boss portion relative to and away from the face plate from said one position to the release position.

8. The chair assembly as defined in claim 6 wherein the boss portion has a size and shape which renders the boss portion difficult to grasp with the hands of an individual and the biasing means has a strength which renders the latch mechanism difficult for the hands of the individual to move to a release position in opposition to the strength of the biasing means.

9. The chair assembly as defined in claim 1 wherein the amusement ride includes a pair of bungee cords, and one end of each bungee cord is secured to the hub-carrying portion of a corresponding bearing assembly so that the cage is permitted to rotate relative to said one ends of the bungee cords so that no kinks are developed in the bungee cords as the cage is rotated relative thereto.

10. A chair assembly adapted to be used with an amusement ride comprising:

a cage having an interior and two opposite sides;

a seat secured within the interior of the cage; and means associated with the opposite sides of the cage for pivotally connecting the cage to the amusement ride so that during the course of a ride performed with the amusement ride, the cage is permitted to pivot relative to the amusement ride in a manner which prevents the exposure of the amusement ride to undue strain; and wherein the pivoting means includes two bearing assemblies joined to the cage on opposite sides thereof, and each bearing assembly includes a spindle-carrying portion which is secured in a stationary condition with respect to the cage and a hub-carrying portion which is rotatably secured to the spindle-carrying portion for rotation with respect thereto, and the pivoting means is adapted to be connected to the amusement ride by way of the hub-carrying portion so that when the pivoting means is connected to the amusement ride as aforesaid, the cage is permitted to rotate relative to the amusement ride as the spindle-carrying portion is permitted to rotate relative to the hub-carrying portion.

11. The chair assembly as defined in claim 10 wherein the amusement ride includes a pair of bungee cords, and one end of each bungee cord is secured to the hub-carrying portion of a corresponding bearing assembly so that the cage is permitted to rotate relative to said one ends of the bungee cords so that no kinks are developed in the bungee cords as the cage is rotated relative thereto.

12. A chair assembly adapted to be used with an amusement ride comprising:

a frame-like cage having an interior and two opposite sides;

at least one seat positioned within the cage interior and affixed to the cage;

a five point harness assembly associated with each seat for securing an occupant within the seat, the harness assembly including a release buckle, two strap sections for draping across the shoulders of the occupant, two straps sections for extending about the hips of the occupant from opposite sides thereof, and a strap section for extending between the legs of the occupant, and each of the strap sections has an end which is releasably connectable to the release buckle at a location disposed in front of the occupant and another end which is anchored to the cage; and means associated with each side of the cage for pivotally connecting the cage to the amusement ride so that during the course of a ride performed by the amusement ride, the cage is permitted to pivot relative to the remainder of the amusement ride; and wherein the pivoting means includes two bearing assemblies joined to the cage on opposite sides thereof, and each bearing assembly includes a spindle-carrying portion which is secured in a stationary condition with respect to the cage and a hub-carrying portion which is rotatably secured to the spindle-carrying portion for rotation wish respect thereof, and the pivoting means is adapted to be connected to the amusement ride by way of the hub-carrying portion so that when the pivoting means is connected to the amusement ride as aforesaid, the cage is permitted to rotate relative to the amusement ride as the spindle-carrying portion is permitted to rotate relative to the hub-carrying portion.

13. The chair assembly as defined in claim 12 wherein each of the strap sections terminate in a clip and the release buckle includes a housing and means associated with the housing for cooperatively interlocking with the clip of each strap section to secure each clip to the release buckle, the interlocking means includes a latch mechanism which is movable between one position at which the interlocking means is cooperatively interlocked with the clips of the strap sections and a release position at which the clips are released from the release buckle, and the release buckle further includes means for biasing the latch member relative to the housing from the release position toward said one position.

14. The chair assembly as defined in claim 13 wherein the housing includes a face plate having an opening therein, the latch mechanism includes a major portion which is positioned within the housing and a boss portion which protrudes through the opening of the face plate of the housing so that the latch mechanism can be moved from said one position to the release position by moving the boss portion relative to and away from the face plate.

15. The chair assembly as defined in claim 14 in combination with a tool for forcibly moving the boss portion away from the face plate as the tool is positioned against the face plate and is manipulated as a lever for moving the boss portion relative to and away from the face plate from said one position to the release position.

16. The chair assembly as defined in claim 12 wherein the amusement ride includes a pair of bungee cords, and one end of each bungee cord is secured to the hub-carrying portion of a corresponding bearing assembly so that the cage is permitted to rotate relative to said one ends of the bungee cords so that no kinks are developed in the bungee cords as the cage is rotated relative thereto.

17. The chair assembly as defined in claim 12 further comprising means for releasably securing the cage to the ground including a post member which depends generally downwardly from the cage, means providing an upwardly-opening sleeve-like guideway fixedly secured to the ground for accepting the post member when the post member is lowered therein, and a rod wherein each of the post member and sleeve-like guideway includes openings which are positionable in alignment with one another when the post member is accepted by the guideway, and the rod is positionable through the aligned openings for releasably securing the post member to the guideway.

* * * * *